US006945298B2

(12) United States Patent
Ludvigsen

(10) Patent No.: US 6,945,298 B2
(45) Date of Patent: Sep. 20, 2005

(54) DEVICE FOR DISPENSING TWO SIDED ADHESIVE TAPE PIECES AND A REFILL ROLL FOR THE DEVICE

(75) Inventor: Frits Ludvigsen, Tommerup (DK)

(73) Assignee: 3L - Ludvigsen A/S, Tommerup (DK)

( * ) Notice: Subject to any disclaimer, the term of this patent is extended or adjusted under 35 U.S.C. 154(b) by 36 days.

(21) Appl. No.: 10/146,908

(22) Filed: May 17, 2002

(65) Prior Publication Data

US 2003/0131944 A1 Jul. 17, 2003

(30) Foreign Application Priority Data

Jan. 16, 2002 (EP) ..... 02388006

(51) Int. Cl.[7] ..... B32B 31/00

(52) U.S. Cl. ..... 156/523; 156/577; 156/579; 206/411; 242/160.4; 242/170; 242/171; 242/588.6

(58) Field of Search ..... 156/577, 523, 156/579, 574, 527, 238, 540; 242/588.2, 588, 588.6, 170, 160.2, 171, 160.4, 588.3; 118/200, 257, 76; 206/411

(56) References Cited

U.S. PATENT DOCUMENTS

| | | | | |
|---|---|---|---|---|
| 3,256,979 A | | 6/1966 | Tschentschel | |
| 3,274,038 A | | 9/1966 | Karn | |
| 3,839,127 A | | 10/1974 | Hazuka et al. | |
| 4,220,495 A | | 9/1980 | Uchida | |
| 4,396,455 A | | 8/1983 | Uchida | |
| 4,704,185 A | | 11/1987 | Fischer | |
| 4,718,971 A | | 1/1988 | Summers | |
| 4,826,562 A | | 5/1989 | Ehlis | |
| 4,851,074 A | | 7/1989 | Hiromichi | |
| 4,851,076 A | | 7/1989 | Manusch et al. | |
| 5,068,004 A | * | 11/1991 | Moll | 156/494 |
| 5,150,851 A | | 9/1992 | Manusch et al. | |
| 5,178,717 A | | 1/1993 | Rodriguez | |
| 5,310,437 A | * | 5/1994 | Tucker | 156/238 |
| 5,316,613 A | | 5/1994 | Samuelson et al. | |
| 5,456,792 A | * | 10/1995 | Rodriguez et al. | 156/577 |
| 5,486,389 A | * | 1/1996 | Gerber | 428/41.9 |
| 6,594,927 B2 | * | 7/2003 | Witkowski | 40/310 |

FOREIGN PATENT DOCUMENTS

JP 2000 302316 10/2000

OTHER PUBLICATIONS

Patent Abstracts of Japan, vol. 2000, No. 13, Feb. 5, 2001; JP 2000 302316; Takebe.
Patent Abstracts of Japan; vol. 1995, No. 04, May 31, 1995; JP 07 010354, Sony Corp.
Disclosure of "3L Tape Runner" (Figs. 1–9).

* cited by examiner

*Primary Examiner*—Chris Fiorilla
*Assistant Examiner*—Cheryl N. Hawkins
(74) *Attorney, Agent, or Firm*—Sughrue Mion, PLLC

(57) ABSTRACT

The device has a roll (1) of a carrier strip (2) holding pieces (3) of two sided adhesive tape and wound on a hub (5) with an outer radius and provided with a circular cogging (6), a support (7) for the roll (1) comprising a stub shaft (9) with a direction of axis around which the roll rotates when dispensing tape pieces (3), a brake pawl (23) for engagement with the circular cogging (6), a pressure base (15) being in connection with the brake pawl (23) such that the engagement of the brake pawl (23) with the cogging (6) is released by pressure on the pressure base (15), a peripheral wall (10) extending along a part of the periphery of the roll (1), and a path for the carrier strip (2) extending past the pressure base (15) and along a part of the outside of the peripheral wall (11), the pressure base (15) comprising an outer sliding surface (16, 17) defining a part of the path for the carrier strip (2) with the two sided adhesive tape where the path at the pressure base (15) comprises a portion with a relative sharp curve (18) with a radius of curvature being essentially smaller than the outer radius of the hub. The two sided adhesive tape (3) is of a relatively rigid material, the two sided adhesive tape (3) being separated from the carrier strip (2) when the latter passes said relatively sharp curve (18) during advance.

8 Claims, 2 Drawing Sheets

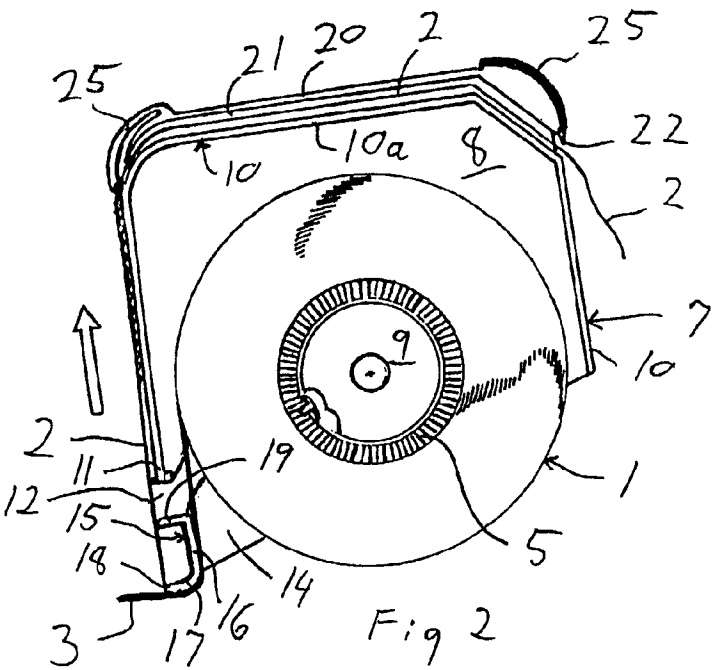
Fig 2
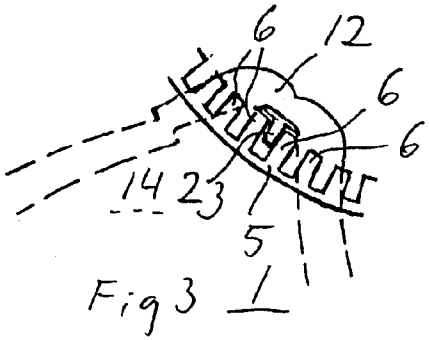
Fig 3
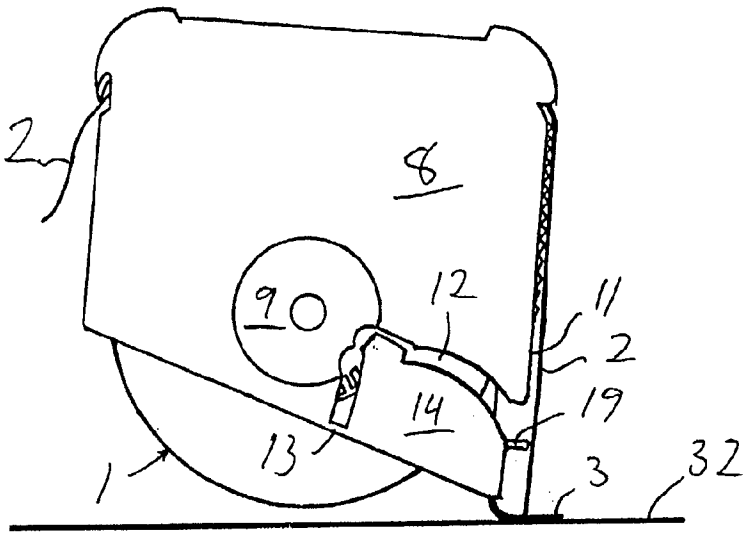
Fig 1
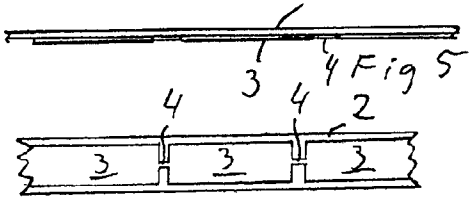
Fig 4
Fig 5

DEVICE FOR DISPENSING TWO SIDED ADHESIVE TAPE PIECES AND A REFILL ROLL FOR THE DEVICE

CROSS-REFERENCE TO RELATED APPLICATIONS

The present application claims the benefit of priority from European Patent Application No. 02388006.5 filed on Jan. 16, 2002.

BACKGROUND OF THE INVENTION

The present invention relates to a device for dispensing two sided adhesive tape pieces, comprising a roll of a carrier strip holding pieces of two sided adhesive tape and wound on a hub with an outer radius and provided with a circular cogging, a support for the roll comprising a stub shaft with a direction of axis around which the roll rotates when dispensing tape pieces, a brake pawl for engagement with the circular cogging, a pressure base being in connection with the brake pawl whereby the engagement of the brake pawl with the cogging is released by pressure on the pressure base, a peripheral wall extending along a part of the periphery of the roll, and a path for the carrier strip extending past the pressure base and along a part of the outside of the peripheral wall, the pressure base comprising an outer sliding surface defining a part of the path for the carrier strip with the two sided adhesive tape where the path at the pressure base comprises a portion with a relatively sharp curve with a radius of curvature being essentially smaller than the outer radius of the hub.

A device of this kind is marketed by the applicant under the trademark "Taperunner". In this known device, the two sided adhesive tape is constituted by a relatively thin, flexible layer on the carrier strip, provided with transverse grooves, the two sided adhesive tape being easily broken when, during use, a piece is applied to a surface desired to be provided with a piece of two sided adhesive tape, e.g. in order to mount a photo or the like. The known device is used by pressing the pressure base against said surface with the carrier strip and the two sided adhesive tape being placed between the pressure base and the surface whereupon the device is drawn along the surface. This causes the two sided adhesive tape to be transferred to the surface while the carrier strip is pushed up behind a deflector assuring the separation of the carrier strip from the two sided adhesive tape. Subsequently, the carrier strip may be detached against a tear-off edge at a downstream end of the deflector.

U.S. Pat. No. 3,839,127 discloses a device for dispensing an adhesive carried by a waste liner from a roll when the device is guided over a surface upon which the adhesive is to be placed. It is also provided with a deflecting member or a 'plough' with an applying edge to separate the waste liner from the adhesive after being placed on a surface.

There are furthermore known boxes containing a roll of carrier strip supporting so-called photo corners. When the carrier strip is drawn out of the box along the outside of a side wall and around the corner to the adjacent side wall of the box, the photo corners are separated from the carrier strip because of their rigidity and the user may seize them by his fingers and place them on a corner of a photo to be mounted on a surface. Such photo corners on a carrier strip are known per se from U.S. Pat. No. 3,256,979.

U.S. Pat. No. 4,704,185 discloses a device for dispensing double sided adhesive tape pieces, labels and the like, where a carrier strip from a roll is guided through a path to an applicator platform with an edge, around this edge and to a mechanism for advancing the carrier strip, the tape pieces being separated from the carrier strip at its passage of said edge. The mechanism provides a strong pull in the carrier strip, which is thus advanced, surmounting the friction in the bearing of the roll on a stub shaft or core.

The fact that the tape pieces are separated from the carrier strip by passage of an edge is called 'dispensing over an edge' and requires that the tape pieces have a certain rigidity such that they can surmount their stickiness to the carrier strip when the strip passes a sharp curve. As a matter of course, the feasibility of 'dispensing over an edge' depends on an interaction existing between three parameters, i.e. the sharpness of the curve of the edge, the force in the stickiness of the tape pieces to the carrier strip and the rigidity of the tape pieces. The person skilled in the art may easily find a suitable combination of these three parameters permitting 'dispensing over an edge'.

Moreover, a large number of patents disclose devices for dispensing an adhesive or double sided adhesive tape from a carrier strip on a supply roll, some devices comprising a roll for winding the carrier strip upon separation of the adhesive or the tape.

U.S. Pat. No. 3,274,038 discloses a device for dispensing an adhesive supplied on a carrier strip. From the delivery place, the carrier strip is guided around the supply roll and out through a slit or into a disposal chamber. The carrier strip with adhesive may be guided over an element against which the strip may be squeezed manually to prevent undesirable advance of the strip.

U.S. Pat. No. 4,220,495 discloses a device for transferring an adhesive supplied on a carrier strip. The device comprises a supply roll and the carrier strip is guided out through the housing wall of the device for tear-off when the adhesive has been disposed on a surface by guiding the supply roll over the surface.

U.S. Pat. No. 4,396,455 discloses a further development of the latter with a resilient piece urging against the supply roll to brake the roll.

U.S. Pat. No. 4,851,074 discloses a device transferring separate double-sided adhesive tape pieces delivered on a carrier strip. Means being provided to assure that after transfer of the tape pieces, the carrier strip is separated from the supply roll and guided out through a slit in the casing wall for tear-off.

U.S. Pat. No. 4,718,971 discloses a device for dispensing an adhesive supplied on a carrier strip. The device comprises a supply reel and a take-up reel for the carrier strip. The two reels are in mutual engagement. The device comprises further a delivery pressure roll for dispensing the adhesive on a surface along which the pressure roll is rolled. The pressure roll is mounted on an end of a lever the other end of which can engage teeth on the supply reel such that the reels are blocked when there is no pressure on the spring bar.

U.S. Pat. No. 4,826,562 discloses a device with a corresponding function, however, in this case, the three rolls are all mounted on a plate which by pressure on the pressure roll tilts in a housing and thus brings a cogging into or out of engagement with a pin which blocks the movement of the supply and take-up roll.

BRIEF SUMMARY OF THE INVENTION

The object of the invention is to provide a simple device for precise dispensing of separate two sided adhesive tape pieces.

According to the invention, this object is achieved by a device of the initially stated kind, which is characterized in that the two sided adhesive tape is of a relatively rigid material, whereby the two sided adhesive tape is separated from the carrier strip when the latter passes said relatively sharp curve during advance. This device permits to advance the carrier strip by means of a finger on the path along the outside of the peripheral wall and thus advance a piece of two sided adhesive tape which due to its rigidity is separated from the carrier strip at the sharp curve of the path of the carrier strip. The tape piece will thus project from the pressure base and may be placed on a desired place without the device being simultaneously advanced along the surface in question.

In a preferred embodiment, the sliding surface of the pressure base extends from a first portion with a tangent directed toward the roll and through a relatively soft curve to a second portion which through the relatively sharp curve directs the path for the carrier strip toward the outside of the peripheral wall. Thereby, the tape piece will project more visibly from the pressure base and may be placed more precisely on a desired place without the device being simultaneously advanced along the surface in question.

In a preferred embodiment, the path for the carrier strip extends after said second portion of the pressure base along the outside of a part of the peripheral wall and then through an interspace between the peripheral wall and a double wall extending along a second part of the peripheral wall along its outside. In this way, the carrier strip may be guided to a tear-off site without hampering the operation of the device. At a downstream edge of the double wall, a tear edge is provided for tear-off of the carrier strip.

Advantageously, the engagement of the brake pawl with the cogging is self-locking such that the engagement cannot be released by traction in the free end of the carrier strip because the pressure base may then be formed such that that merely a small force on the pressure base must be applied in order to bring the brake pawl out of engagement with the cogging. This can be obtained e.g. in that the cogging comprises teeth with surfaces having an axial extent and an essentially radial tangent.

The tape pieces preferably stick together by a narrow material piece between neighboring pieces or by the glue with which they are provided. Thus, it is assured that the tape pieces follow the correct side of the carrier strip when this is unwound from the roll.

The support is preferably a plastic item with an overall wall thickness of a few millimeters or less and comprising a side wall from which the stub shaft rises as a hollow projection, and the peripheral wall extends along a part of the periphery of the side wall. A support of inexpensive production is thus obtained.

The support with the roll is preferably imbedded in a box with a perforation for tear-off of a part of the box to expose a part of the device for use. The box may thus be used both as a part of the device during usage, i.e. to seize, and as a sales packaging, whereby the device may be produced as a throwaway.

For an embodiment where the support is used several times, the invention also relates to a refill roll for the device according to the invention with a carrier strip holding pieces of two sided adhesive tape and wound on a hub with an outer radius and provided with a circular cogging, where the tape pieces are of a relatively rigid material, the two sided adhesive tape being separated from the carrier strip when during advance passing a curve with a radius of curvature being essentially smaller than the outer radius of the hub, where the cogging comprises teeth with surfaces having an axial extent and an essentially radial tangent.

In the refill roll, the tape pieces are preferably mutually connected by a narrow material piece between neighboring pieces.

BRIEF DESCRIPTION OF THE SEVERAL VIEWS OF THE DRAWING

Examples of the invention will now be explained below with reference to the very schematic drawings, in which FIG. 1 shows a device according to the invention seen from one side, FIG. 2 the device in FIG. 1 seen from the opposite side, FIG. 3 an enlarged section of FIG. 2, FIG. 4 a piece of carrier strip with tape pieces, FIG. 5 the carrier strip in FIG. 4 seen from the side.

DETAILED DESCRIPTION OF THE INVENTION

Figure 6:
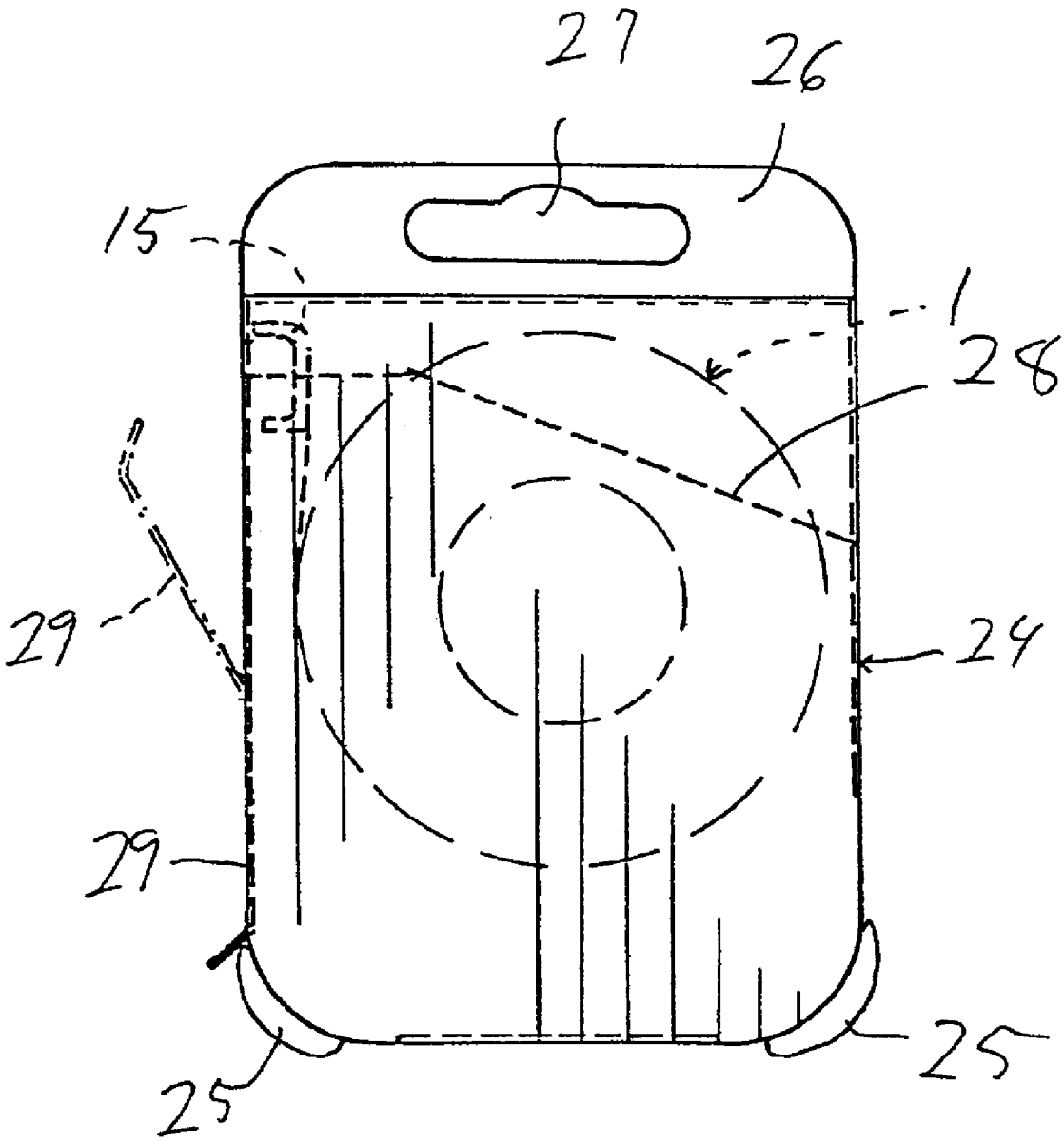
FIG. 6 shows the device in a box.

The device for dispensing two sided adhesive tape pieces comprises a roll 1 of a carrier strip 2 holding two sided adhesive tape pieces 3. The tape pieces 3 may be of a conventional tape with a core of paper or plastic coated with an adhesive on both sides. The carrier strip 2 is likewise of a conventional type and releases easily the tape pieces 3.

Adjacent tape pieces 3 are preferably mutually connected by means of a narrow material strip 4, a so-called 'louse'.

The roll 1 is wound on a hub 5 with an internal, circular cogging with teeth 6.

The roll 1 is embedded in a support 7 in the form of a molded plastic item having an overall wall thickness of a few millimeters or less. The support 7 comprises a side wall 8 with an essentially quadrangular contour. From the side wall 8, a hollow stub shaft 9 rises in the form of an essentially cylindrical projection extending up through the hub 5 in order to support the roll 1 in a rotational manner.

Along three of the peripheral sides of the side wall 8, a peripheral wall 10 extends. At the fourth peripheral side, the support 7 is open to permit the roll 1 protrude from the support 7.

From one end of a first portion 11 of the peripheral wall 10, a recess 12 extends into the side wall 8, into the stub shaft 9 and down to the fourth peripheral side, a narrow material strip or a hinged portion 13 being left acting as a resilient hinge to be described further below.

The recess 12 defines a resilient movable pressure base portion 14, the rest position of which is shown in FIGS. 1 and 2. The pressure base portion 14 carries a pressure base element 15 essentially in the form of a J. A vertical part 16 of the pressure base element, as seen in FIG. 2, constitutes a part of a slide for the carrier strip 2 with tape pieces 3. The slide continues from the vertical part 16 through a curved part 17 to an edge 18 terminating the slide. At the edge 18, the curved part 17 has a tangent direction which is approximately perpendicular to the adjacent first portion 11 of the peripheral wall 10. A top horizontal part 19 of the pressure base element 15 constitutes an abutment for the first adjacent wall portion 11 to limit the movement of the pressure base portion 14 in the direction toward said wall portion 11.

Along the essentially horizontal top portion 10*a* of the peripheral wall 10, as seen in FIG. 2, a double wall 20 extends, a canal 21 being formed between the peripheral wall 10 and the double wall 20. Through this canal 21, the carrier strip 2 may pass. At the downstream end of the double wall 20, a tear-off edge 22 for tearing off the carrier strip 2.

The pressure base portion 14 has at the stub shaft 9 a cam 23 extending down between two teeth 6 in the cogging of the hub 5 when the pressure base portion 14 is in its rest position. Both the teeth 6 and the cam 23 have, as seen in FIG. 2, essentially parallel sides, the cam 5 not being inclined to be pushed out of engagement if a force tries to turn the roll 1 while the cam 23 is in engagement with the teeth 6.

By pressure on the pressure base element 15 in a direction toward the first adjacent side wall 11, the entire pressure base portion 14 will rotate about the hinged portion 13 and the cam 23 will be moved toward the center of the hub 5 and out of engagement with the teeth 6.

Rotation of the roll 1 is thus prevented when the pressure base portion 14 is in its rest position, however, feasible when a sufficiently pressure on the pressure base element 15 has turned the pressure base portion 14 such that the cam 23 is out of engagement with the teeth 6.

FIG. 6 shows the support 7 with the roll 1 embedded in a box 24 essentially encompassing the support and roll, however, corners 25 of the support 7 project from the box 24. The box 24 has in its one end a flap 26 with a loop 27 for suspension in a sales exhibition. The box 24 acts thus as a sales packaging. The box 24 has a perforation 28 by which the end with the flap 26 can be torn off, the bottom parts of the roll 1 and the pressure base element 15 being uncovered for use of the device. It is to be noted that the device when suspended in the loop 27 has the bottom up. The remaining part of the box 24 acts thus as a protection of the device, prevents the roll from falling off the support 7, and makes it more comfortable for a user to seize the device without risking to seize the roll itself 1 and unintentionally impede its rotation. During use, a part 29 of the side wall of the box 24 is turned away from the side wall 11 of the support as shown with a broken line in FIG. 6 in order to give access to the side wall 11 as will be described below.

The device is used in the following way.

The bottom part of the box is torn off along the perforation 28 and the part 29 of the side wall of the box is turned away from the side wall 11 or is completely torn off. Subsequently, the user seizes with one hand the support 7 with the double wall 20 facing the palm of the hand. With his index finger, the user pulls the carrier strip 2 along the wall portion 11 in the direction of the arrow 30. This entails a traction in the pressure base element 15 toward the adjacent wall portion 11 and the cam 23 is brought out of engagement with the teeth 6, the pressure base portion 14 being rotated about the hinged portion 13. A continuous traction in the carrier strip 2 along the wall portion 11 entails that the carrier strip 2 with tape pieces 3 is pulled forward from the roll 1 along the vertical part 16 and the curved part 17 of the pressure base element 15 to the edge 18. At this place, the carrier strip 2 turns sharply around the corner to continue up toward and along the wall portions 11. The tape pieces 3 have a rigidity which implies that they release their adhesive grip in the carrier strip 2 at the edge 18 and let themselves be forwarded in the tangent direction of the pressure base element 15 as seen in FIG. 2.

At this time, the advance of the carrier strip 2 is stopped and the tape piece 3 is pressed against a surface 32, on which it is to be placed, e.g. a piece of paper or cardboard, subsequently to adhere a photo on the place. When the device is then lifted, the tape piece will as it adheres to the surface 32 pull the carrier strip 2 and draw further a small length hereof off the roll 1. However, the pressure against the pressure base element 15 will thus be released and the pressure base portion 14 returns to its rest position, the cam 23 entering into locking engagement with the teeth 6 to block the roll 1. The tape pieces 3 will therefore be pulled free of the carrier strip 2, the louse 4 being torn.

The user may then by means of his index finger pull a new tape piece forward. The carrier strip 2 which is free from tape pieces will be pushed through the channel 21 and hampers thus not the handling of the device. After use, the free end of the carrier strip 2 is torn off against the tear-off edge 22.

A substantial feature of the invention is the cooperation between the rigidity of the tape pieces 3, their attachment to the carrier strip 2 and the curve of the path of the carrier strip 2 along the pressure base 15. As the carrier strip 2 after having left the roll 1 encounters a part 16 or 17 of the pressure base 15 which has a tangent direction pointing toward the periphery of the roll 1 and then is guided along another part 17 of the pressure base with a soft curve, the tape pieces 3 will so far not be inclined to be separated from the carrier strip 2. Not until the carrier strip 2 is passed around the edge 18, its path bends so much that the tape pieces 3 are separated from the carrier strip 2. It is to be noted that the vertical part 16 has a tangent direction pointing essentially toward the periphery of the roll. 1 before use begins. As the tape pieces 3 are used and the carrier strip 2 is unwound from the roll 1 which will thus diminish, the point on the pressure base 15 with a tangent direction pointing toward the periphery of the roll 1 is displaced to the curved part 17.

The purpose of the lice 4 is first and foremost to obtain the effect that the tape pieces 3 on the place where the carrier strip 2 is pulled away or unwound from the roll 1 will follow each other on the unwound carrier strip part and not stay on the outside of the roll 1. Alternatively, the adhesion between the carrier strip 2 and the two different sides of the tape pieces 3 could be adapted such that said effect is assured. However, the lice 4 constitute a solution technically more simple and a more reliable solution. Instead of or as a supplement to the lice 4 consisting of a small part of the core material of the tape pieces, the tape pieces 3 can adhere by the glue surrounding the core material.

I claim:

1. A device for dispensing two sided adhesive tape pieces (3), comprising a roll (1) of a carrier strip (2) holding pieces (3) of two sided adhesive tape and wound on a hub (5) with an outer radius and provided with a circular cogging (6), a support (7) for the roll (1) comprising a stub shaft (9) with a direction of axis around which the roll rotates when dispensing tape pieces (3), a brake pawl (23) for engagement with the circular cogging (6), a pressure base (15) thus connected to the brake pawl (23) that the engagement of the brake pawl (23) with the cogging (6) is released by pressure against the pressure base (15), a peripheral wall (10) extending along a part of the periphery of the roll (1), and a path for the carrier strip (2) extending past the pressure base (15) and along a part of the outside of the peripheral wall (11), the pressure base (15) comprising an outer sliding surface (16, 17) defining apart of the path for the carrier strip (2) with the two sided adhesive tape where the path at the pressure base (15) comprises a portion with a relatively sharp curve (18) with a radius of curvature being essentially smaller than the outer radius of the hub, wherein the two sided adhesive tape (3) is of a relatively rigid material, whereby the two sided adhesive tape (3) is separated from the carrier ship (2) when the latter passes said relatively sharp curve (18) during advance.

2. A device according to claim 1, wherein the sliding surface of the pressure base (15) extends from a first portion (16) with a tangent directed toward the roll (1) and through a relatively soft curve (17) to a second portion which through the relatively sharp curve (18) directs the path for the carrier strip (2) toward the outside of the peripheral wall (11).

3. A device according to claim 2, wherein the path for the carrier strip (2) extends after said second portion (18) of the pressure base (15) along the outside of a part (11) of the peripheral wall (10) and then through an interspace (21) between the peripheral wall (10) and a double wall (20) extending along a second part **(10*a*)** of the peripheral wall along its outside.

4. A device according to claim 3, wherein a downstream edge of the double wall (20) is provided with a tear edge (22) for tear-off of the carrier strip (2).

5. A device according to claim 1, wherein the cogging comprises teeth (6) with surfaces having an axial extent and an essentially radial tangent.

6. A device according to claim 1, wherein the tape pieces (3) are mutually connected by a narrow material piece (4) between neighboring pieces.

7. A device according to claim 1, wherein the support (7) is a plastic item with an overall wall thickness of a few millimeters or less and comprising a side wall (8) from which the stub shaft (9) rises as a hollow projection, and the peripheral wall (11) extends along a part of the periphery of the side wall (6).

8. A device according to claim 1, wherein the support (7) with the roll (1) is embedded in a box (24) with a perforation (28) for tear-off of a part of the box (24) to expose a part of the device for use.

* * * * *